US008622001B1

(12) United States Patent
Patel et al.

(10) Patent No.: US 8,622,001 B1
(45) Date of Patent: Jan. 7, 2014

(54) KINETIC ENERGY FRAGMENTING WARHEAD AND PROJECTILE INCORPORATING SAME

(75) Inventors: Umang R. Patel, Mansfield, TX (US); Jesse R. Cannon, Grand Prairie, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 0 days.

(21) Appl. No.: 13/187,624

(22) Filed: Jul. 21, 2011

(51) Int. Cl.
*F42B 12/06* (2006.01)

(52) U.S. Cl.
USPC ..... 102/494

(58) Field of Classification Search
USPC ..... 102/491, 492, 493, 494, 495, 496, 506, 102/514
See application file for complete search history.

(56) References Cited

U.S. PATENT DOCUMENTS

| | | | | |
|---|---|---|---|---|
| 1,305,967 | A * | 6/1919 | Hawks | 102/494 |
| 3,954,060 | A * | 5/1976 | Haag et al. | 102/494 |
| 2006/0054047 | A1 * | 3/2006 | Burri | 102/494 |

* cited by examiner

*Primary Examiner* — Michelle Clement
*Assistant Examiner* — John D Cooper
(74) *Attorney, Agent, or Firm* — Slater & Matsil, L.L.P.

(57) ABSTRACT

A kinetic energy fragmenting warhead includes a penetrator, a plurality of fragments disposed about the penetrator, and a sleeve disposed about at least some of the plurality of fragments. A projectile includes a body and a kinetic energy fragmenting warhead disposed in the body. The kinetic energy fragmenting warhead includes a penetrator, a plurality of fragments disposed about the penetrator, and a sleeve disposed about at least some of the plurality of fragments.

20 Claims, 8 Drawing Sheets

KINETIC ENERGY FRAGMENTING WARHEAD AND PROJECTILE INCORPORATING SAME

BACKGROUND

1. Field of the Invention

The present invention relates generally to kinetic energy warheads and projectiles incorporating kinetic energy warheads.

2. Description of Related Art

It is common in combat situations for an adversary to shield personnel, equipment, munitions, and the like within protective buildings, armored vehicles, or other such enclosures. Historically, primitive munitions were effective in penetrating such enclosures but were ineffective in neutralizing the adversary's assets housed therein. In response to this need, projectiles were developed that employ kinetic energy, a forward-firing shaped charge, or the like for penetrating and entering such enclosures and, once inside the enclosure, an explosive is detonated via a time-delay fuze to disperse fragments to defeat the adversary's assets housed within the enclosure.

The use of explosives, however, can present difficulties and dangers. For example, special facilities must be employed in which the explosive-containing projectiles are manufactured. Special care must be provided during the manufacturing process to ensure that the explosives used are not inadvertently detonated. Projectiles that contain explosives must be carefully handled during transportation to storage or combat areas and, once in these locations, must be stored in such ways that the explosive neither becomes degraded nor is inadvertently detonated. Moreover, such conventional warheads and projectiles typically require complex structure and control systems, which are often costly.

There are many designs of projectiles well known in the art that can penetrate enclosures and defeat assets disposed therein; however, considerable shortcomings remain.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

FIG. 11 is a side, elevational view of an illustrative embodiment of a projectile incorporating the embodiment of FIG. 1, the embodiment of FIG. 8, or the like.

Figure 1:
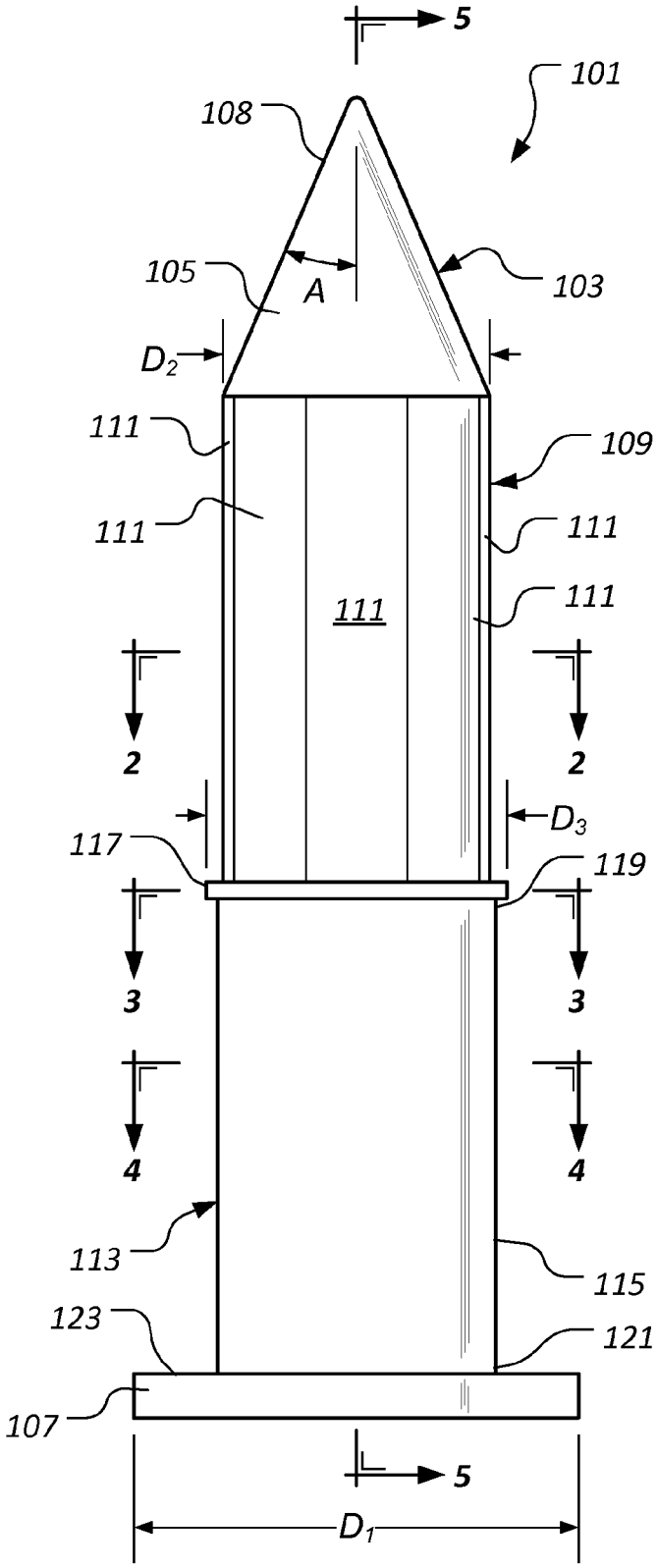
FIG. 1 is a side, elevational view of an illustrative embodiment of a kinetic energy fragmenting warhead.
Figure 2:
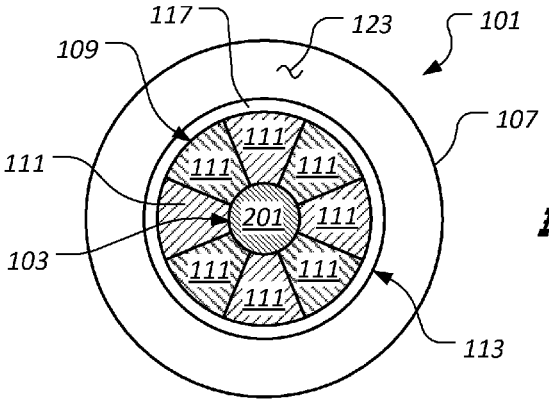
FIG. 2 is a cross-sectional view of the embodiment of FIG. 1, taken along the line 2-2 in FIG. 1.
Figure 3:
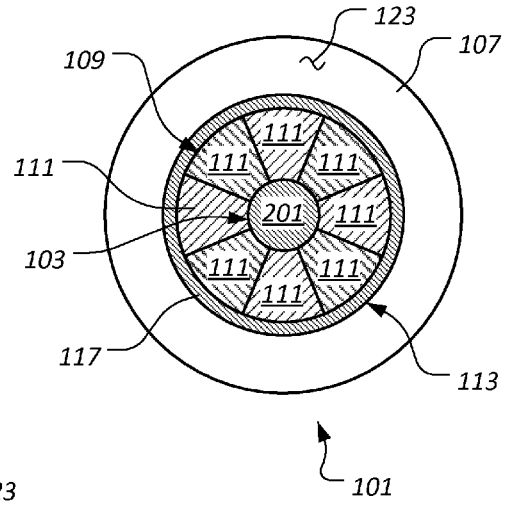
FIG. 3 is a cross-sectional view of the embodiment of FIG. 1, taken along the line 3-3 in FIG. 1.
Figure 4:
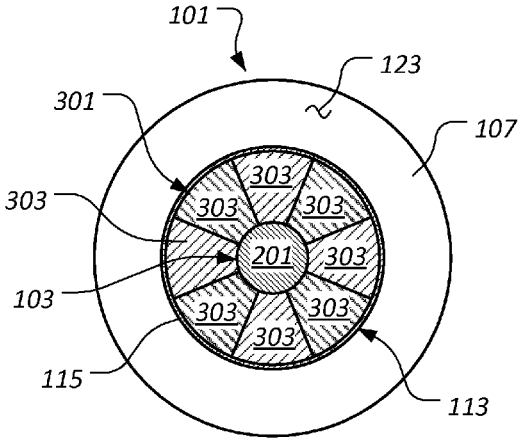
FIG. 4 is a cross-sectional view of the embodiment of FIG. 1, taken along the line 4-4 in FIG. 1.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Reference will now be made in detail to the present exemplary embodiments of the invention, examples of which are illustrated in the accompanying drawings.

A kinetic energy fragmenting warhead includes a penetrator, a plurality of fragments disposed about the penetrator, and a sleeve disposed about at least some of the plurality of fragments. A projectile includes a body and a kinetic energy fragmenting warhead disposed in the body.

FIGS. 1-5 depict a first illustrative embodiment of a kinetic energy fragmenting warhead 101. FIG. 1 is a side, elevational view of warhead 101. FIGS. 2-5 are cross-sectional views of warhead 101, as referenced in FIG. 1. In the illustrated embodiment, warhead 101 comprises a penetrator 103 including a tapered nose 105, a base 107, and a shaft 201 extending between nose 105 and base 107. In one embodiment and referring in particular to FIG. 1, a forward face 108 of nose 105 defines a taper angle A, configured to minimize a decrease in velocity of warhead 101 as warhead 101 penetrates an enclosure, such as an armored enclosure. Taper angle A, however, is implementation specific depending upon, for example, the type of material that is to be penetrated by warhead 101, the configuration of material that is to be penetrated by warhead 101, the angle at which warhead 101 is expected to impact a target, and/or design parameters of a projectile housing warhead 101, such as space available in the warhead, the material of penetrator 103, the anticipated velocity of warhead 101 when impacting a target and/or the like. Accordingly, the present invention contemplates many different configurations for nose 105, including taper angle A. Still referring in particular to FIG. 1, base 107 exhibits an outer transverse dimension $D_1$ that is greater than a maximum transverse dimension $D_2$ of nose 105, so that forward motion of penetrator 103 is generally halted or substantially inhibited after nose 105 penetrates an enclosure, as is discussed in greater detail herein.

Referring again to FIGS. 1-5, a plurality of sets of fragments is disposed about shaft 201, between nose 105 and base 107. In the embodiment illustrated in FIGS. 1-5, warhead 101 comprises a first set 109 of fragments 111 disposed proximate nose 105 and a second set 301 of fragments 303 disposed proximate base 107. It should be noted that the scope of the present invention encompasses embodiments incorporating more than two sets of fragments and sets of fragments comprising more than eight fragments. In the illustrated embodiment, first set 109 of fragments 111 generally abuts second set 301 of fragments 303. Warhead 101 further comprises a sleeve 113 disposed about second set 301 of fragments 303 and disposed about at least a portion of first set 109 of fragments 111 to retain fragments 111 and 303 proximate penetrator 103. While sleeve 113 extends generally about an entirety of second set 301 of fragments 303, sleeve 113 extends over first set 109 of fragments 111 by a dimension X, which is sufficient to retain fragments 111 proximate penetrator 103. Sleeve 113 comprises a body 115 and a flange 117 extending from a first end 119 of body 115. A second end 121 of sleeve 113 generally abuts a face 123 of base 107 or is proximate face 123 of base 107. Sleeve 113 does not freely slide along sets 109 and 301 of fragments 111 and 303, respectively, but is retained in place generally abutting face 123 of base 107 or proximate face 123 of base 107, such as by friction between sleeve 113 and second set 301 of fragments 303 or the like. Flange 117 of sleeve 113 exhibits an outer transverse dimension $D_3$ that is greater than a maximum transverse dimension $D_2$ of nose 105 and body 115 of sleeve 113 is configured by at least the material chosen for sleeve 113 and/or a thickness T (shown in FIG. 5) of body 115, so that sleeve 113 is crumpled, is deformed, is compressed, fails, structurally fails, or the like to release sets 109 and 301 of fragments 111 and 303, respectively when impacting an enclosure through which penetrator 103 has pierced, as is discussed in greater detail herein. It should be noted that the meanings of terms "crumple" or "crumpled", as used herein, include being deformed, compressed, failed, structurally failed, or the like. Thickness T of sleeve 113 is sufficiently thick to retain fragments 111 and 303 up to and including initial penetration into a target but is thin enough to crumple as warhead 101 enters the target. In one embodiment, sleeve 113 comprises aluminum or an aluminum alloy. The scope of the present invention is not so limited, however. For example, sleeve 113 may comprise metals other than aluminum or an aluminum alloy and may comprise a polymeric material.

Figure 5:
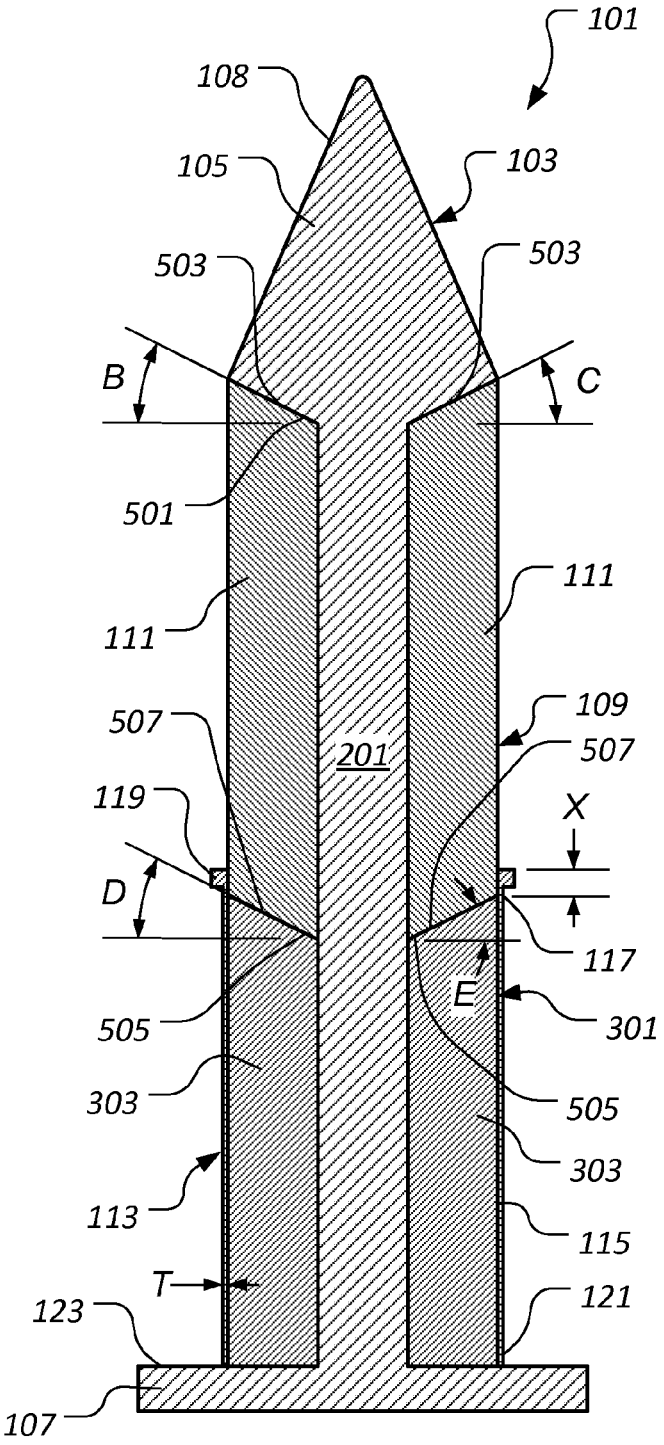
FIG. 5 is a cross-sectional view of the embodiment of FIG. 1, taken along the line 5-5 in FIG. 1.

Referring in particular to FIG. 5, an aft surface 501 of nose 105 is generally conical in nature and exhibits an angle B that allows set 109 of fragments 111 to be outwardly deployed away from shaft 201 when sleeve 113 is crumpled, deformed, compressed, or the like, as a result of impacting an enclosure. In the illustrated embodiment, a forward surface 503 of each of fragments 111 of set 109 exhibits an angle C corresponding to angle B of aft surface 501, which allows fragments 111 of set 109 to be freely radially deployed when sleeve 113 is crumpled, deformed, compressed, or the like, as a result of impacting an enclosure. Similarly, an aft surface 505 of each of fragments 111 of set 109 exhibits an angle D that allows set 301 of fragments 303 to be outwardly deployed away from shaft 201 when sleeve 113 is crumpled, deformed, compressed, or the like, as discussed above. In the illustrated embodiment, a forward surface 507 of each of fragments 303 of set 301 exhibits an angle E corresponding to angle D of aft surfaces 505, which allows fragments 303 of set 301 to be freely radially deployed when sleeve 113 is crumpled, deformed compressed, or the like. The particular value of angle B employed in a particular embodiment, however, is implementation specific. Angles B-D affect the outward or radial velocities of fragments 111 and 303, which can be varied according to the present invention based at least upon the implementation of warhead 101.

Figure 6:
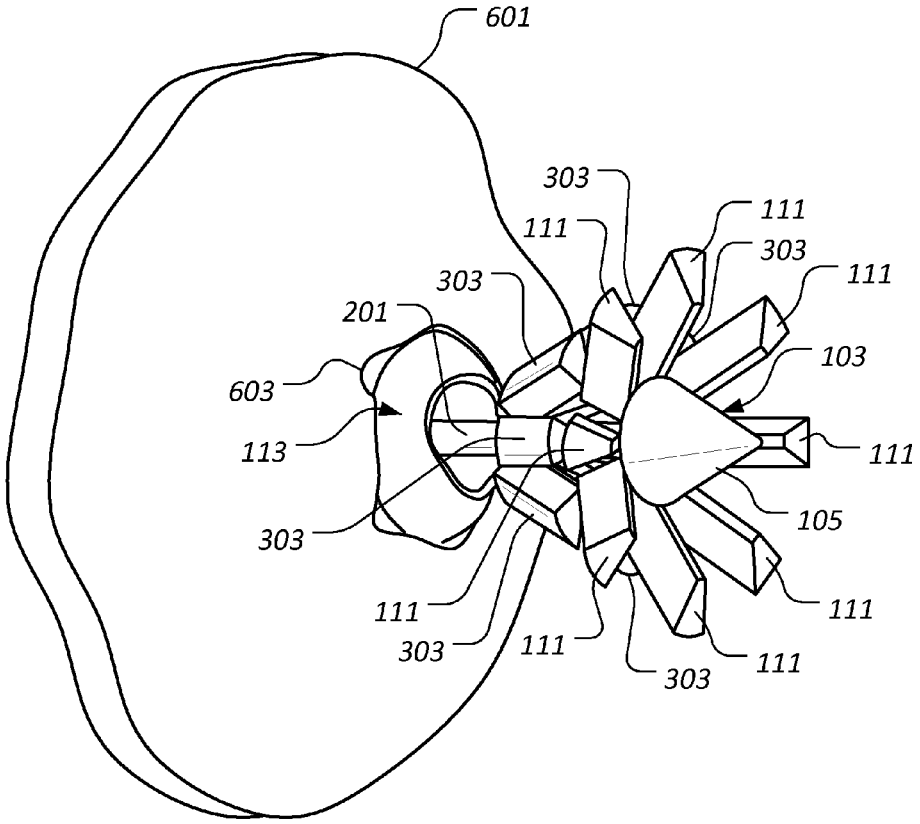
FIG. 6 is a perspective view depicting an illustrative use of the warhead embodiment of FIG. 1.
Figure 7:
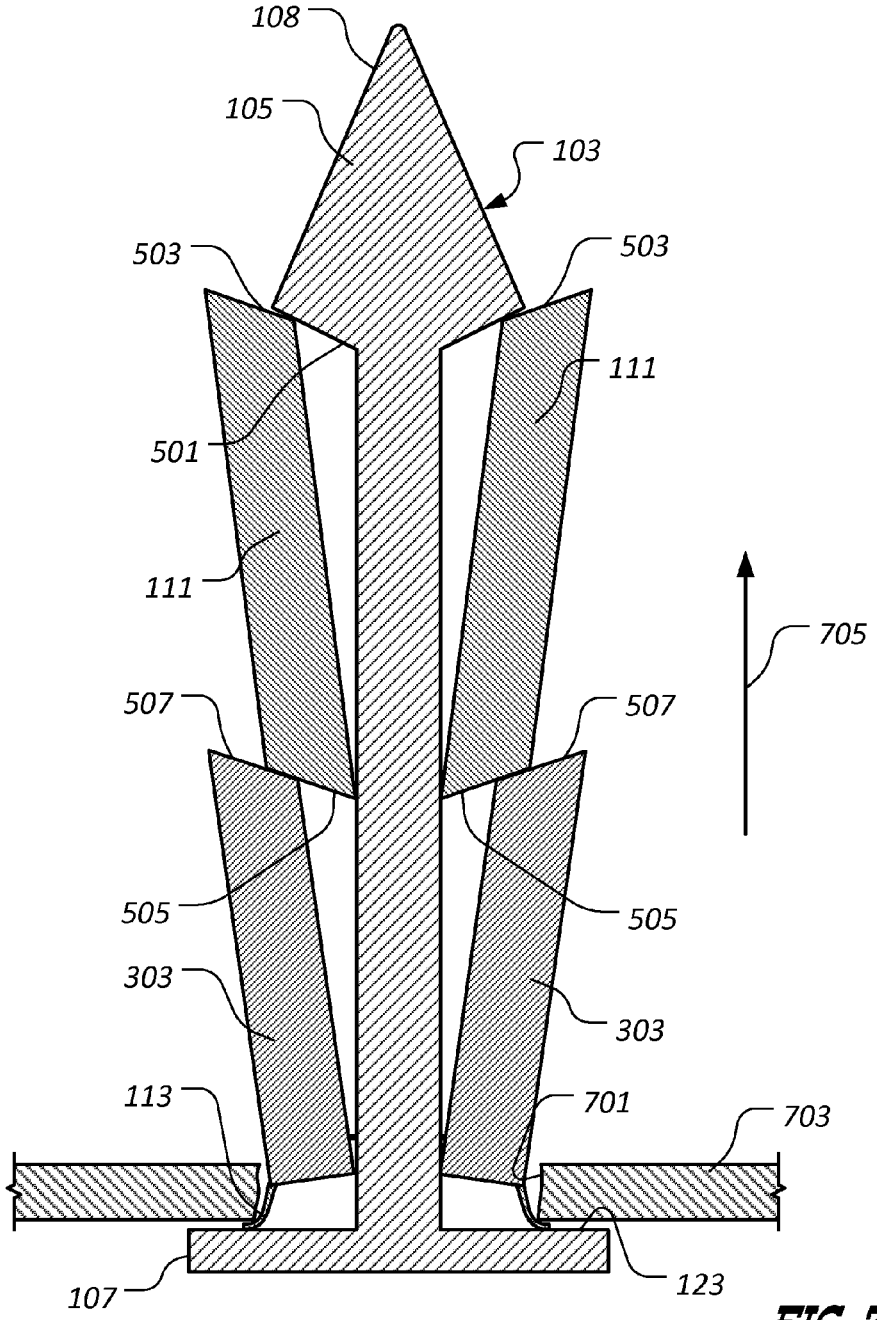
FIG. 7 is a cross-sectional view, corresponding to the view of FIG. 5, depicting an illustrative use of the warhead embodiment of FIG. 1.

FIG. 6 depicts warhead 101 in an exemplary use. Specifically, FIG. 6 depicts certain portions of warhead 101 after penetrator 105 has penetrated an enclosure 601. As penetrator 105 penetrates enclosure 601, an opening 603 is formed. Sleeve 113 exhibits a dimension, as discussed herein, that prohibits or at least inhibits sleeve 113 from passing through opening 603. Sleeve 113 becomes crumpled, deformed, compressed, or the like, as a result of impacting enclosure 601 and being compressed between enclosure 601 and base 107 of penetrator 103, thus releasing penetrators 111 and 303. Forward motion of penetrator 105 is halted or at least is substantially decreased by interaction between base 107 and enclosure 601, which results in relative motion between moving fragments 111 and 303 and generally stationary penetrator 105. FIG. 7 depicts this action particularly well. In the particular implementation of FIG. 7, sleeve 113 and penetrator 103 do not pass through an opening 701 produced in an enclosure structure 703 by nose 105 of penetrator 103. Fragments 111 and 303 are not constrained, however, resulting in relative motion between fragments 111 and 303 and penetrator 103. Cooperation between of aft surface 501 (exhibiting angle B, shown in FIG. 5) of nose 105 and forward surfaces 503 (exhibiting angle C, shown in FIG. 5) of fragments 111 and cooperation between aft surfaces 505 (exhibiting angle C, shown in FIG. 5) of fragments 111 of set 109 and forward surfaces 507 (exhibiting angle D, shown in FIG. 5) of fragments 303 of set 301 in combination with the relative motion of fragments 111 and 303 with respect to penetrator 103, as indicated by an arrow 705, causes fragments 111 and 303 to be radially dispersed away from penetrator 103.

Figure 8:
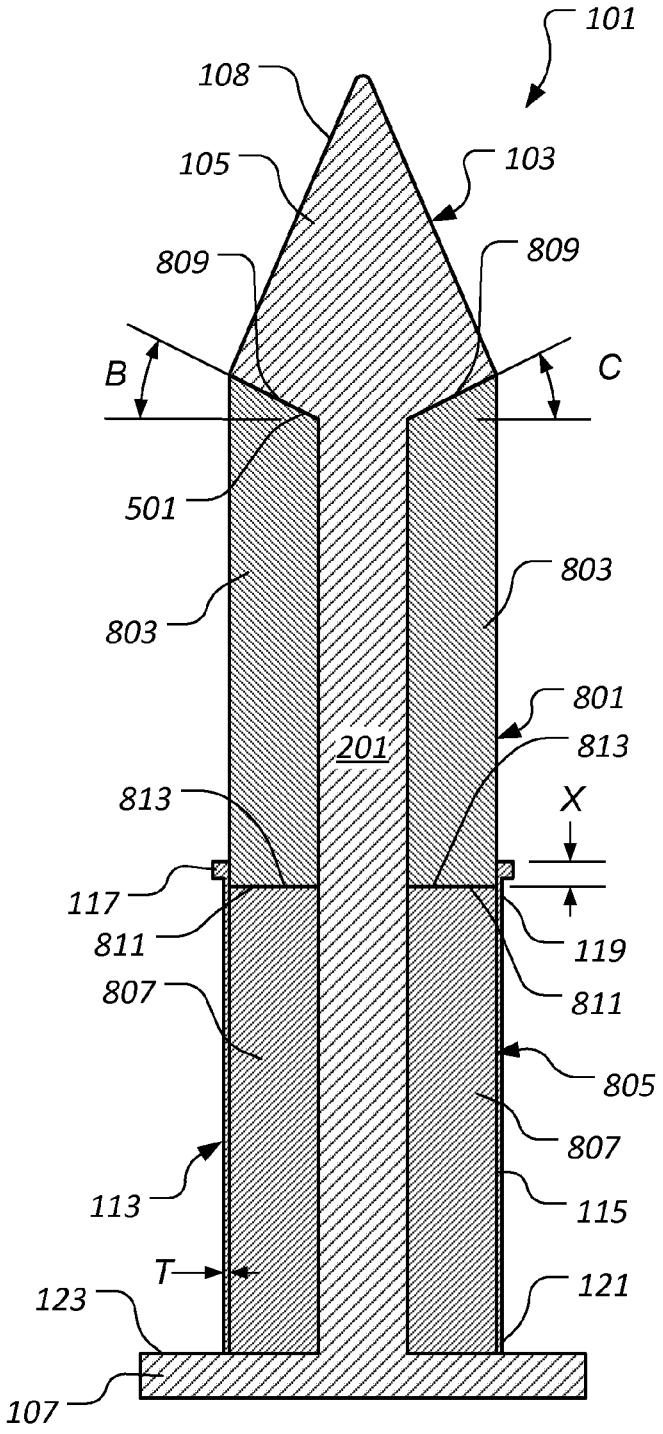
FIG. 8 is a cross-sectional view, corresponding to the view of FIG. 5, depicting an alternative, illustrative embodiment of a kinetic energy fragmenting warhead.

It should be noted, however, that the present invention contemplates embodiments wherein one or more sets of fragments, corresponding to, for example, sets 109 and 301, do not exhibit tapered angles, such as angles C-E, shown in FIG. 5. In such embodiments, one or more sets of fragments exhibit generally square ends. One such embodiment is shown in FIG. 8, which comprises a first set 801 of fragments 803 disposed proximate nose 105 and a second set 805 of fragments 807 disposed proximate base 107. It should be noted that the scope of the present invention, as discussed herein concerning the previous embodiment, encompasses embodiments incorporating more than two sets of fragments and sets of fragments comprising more than eight fragments. As in the embodiment of FIGS. 1-7, aft surface 501 of nose 105 is generally conical in nature and exhibits angle B that allows set 801 of fragments 803 to be outwardly deployed away from shaft 201 when sleeve 113 is crumpled, deformed, compressed, or the like, as a result of impacting an enclosure. Also, corresponding to the embodiment of FIGS. 1-7, forward surface 809 of each of fragments 803 of set 801 exhibits an angle C corresponding to angle B of aft surface 501, which allows fragments 803 of set 801 to be freely radially deployed when sleeve 113 is crumpled, deformed, compressed, or the like, as a result of impacting an enclosure. An aft surface 811 of each fragment 803 of set 801 and a forward surface 813 of each fragment 807 of set 805, however, exhibit generally "square" or right-angle configurations, rather than exhibiting tapered angles as in the embodiment of FIGS. 1-7. In such an embodiment, fragments 807 are not substantially radially dispersed away from shaft 201 until they encounter aft surface 501 of nose 105, which alters the radial dispersion pattern and timing of fragments 807. It should be noted that either or both of fragments 803 and 807 may exhibit end surfaces that exhibit generally square configurations.

Figure 9:
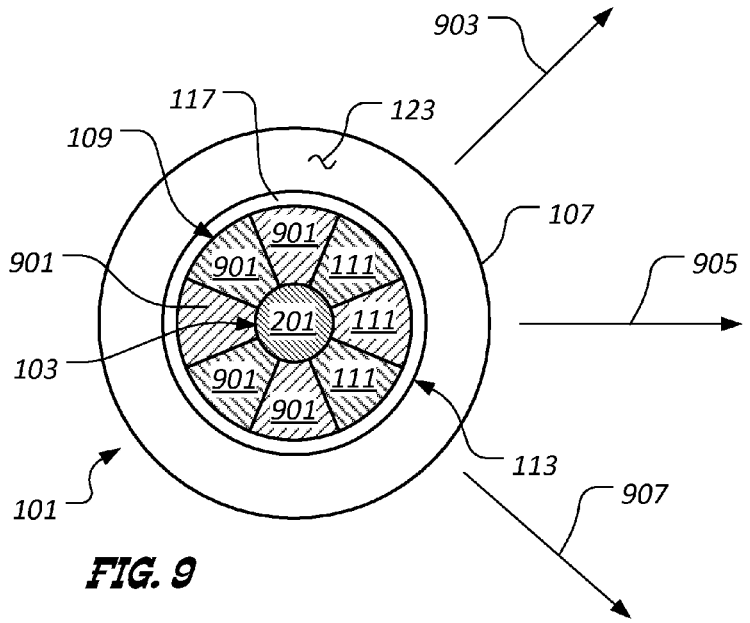
FIGS. 9 and 10 are cross-sectional views, corresponding to the view of FIG. 2, depicting yet another alternative, illustrative embodiment of a kinetic energy fragmenting warhead.
Figure 10:
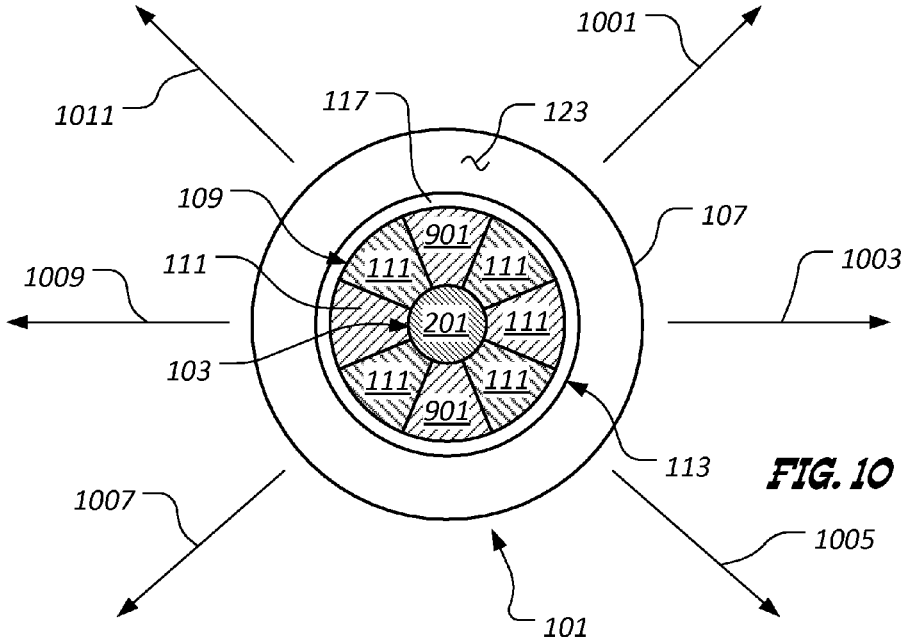

In the embodiments of FIGS. 1-5, 7, and 8, set 109 includes fragments 111 disposed about a substantially complete circumference of shaft 201. Thus, when sleeve 113 is crumpled, deformed, compressed, or the like as a result of impacting an enclosure, fragments 111 are outwardly deployed generally uniformly radially away from warhead 101. The scope of the present invention, however, is not limited to this configuration. Rather, the sets of fragments can include configurations wherein one or more fragments are radially outwardly but non-uniformly deployed away from warhead 101. FIGS. 9 and 10 depict illustrative embodiments of such configurations, in which some of the fragments 111 of the embodiments of FIGS. 1-5, 7, and 8 are replaced with spacers 901 made from one or more materials not suitable for fragments, such as one or more polymeric materials. In the particular illustrative embodiment of FIG. 9, fragments 111 and spacers 901 are arranged such that fragments 111 are dispersed only in directions generally corresponding to arrows 903, 905, and 907. In the embodiment of FIG. 10, fragments 111 and spacers 901 are arranged such that fragments 111 are dispersed only in directions generally corresponding to arrows 1001, 1003, 1005, 1007, 1009, and 1011. It should be noted that such fragment and spacer configurations may also be utilized in set 301. The scope of the present invention includes any combination of fragments 111 or 303 and spacers 901 (or the like). Sets 109 and 301 may include the same configurations of fragments and spacers or may exhibit different configurations of fragments and spacers. It should also be noted that the present invention contemplates other ways wherein the fragments are outwardly deployed in only one predetermined direction or in a plurality of predetermined directions away from shaft 201.

Figure 11:
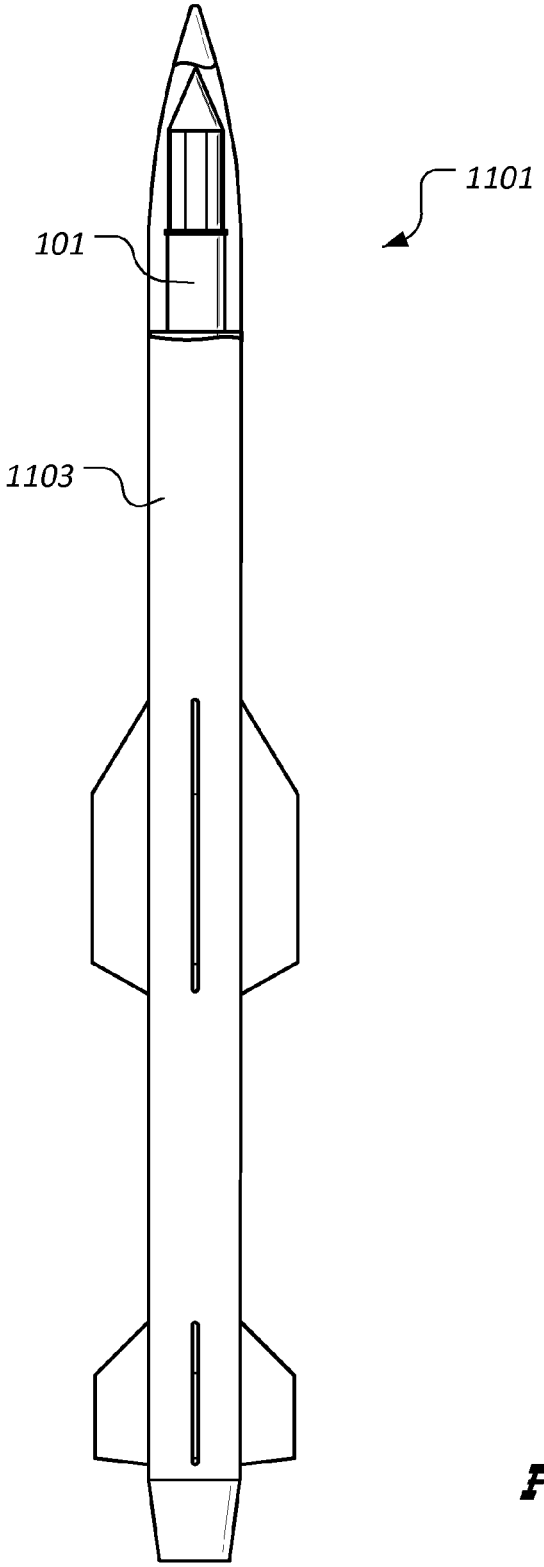

FIG. 11 depicts an illustrative embodiment of a projectile 1101 comprising warhead 101. In the illustrated embodiment, projectile 1101 comprises a body 1103 in which warhead 101 is disposed. Projectile 1101 is configured to propel warhead 101 to a target, such as an enclosure, and to impact the target such that warhead 101 is effective in breaching the enclosure or target and dispersing fragments thereof within the enclosure or target. It should be noted that any embodiment of warhead 101 shown and described herein or encompassed by the present invention may be utilized in projectile 1101.

The present invention provide significant advantages including, but not limited to, (1) providing a warhead that is capable of penetrating an enclosure and dispersing fragments within the enclosure without the use of explosive materials; and (2) providing a warhead that is capable of penetrating an armored enclosure and dispersing fragments within the enclosure without the use of explosive materials.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A kinetic energy fragmenting warhead, comprising:

a single-piece penetrator, wherein the penetrator comprises a nose, a base, and a shaft extending between the nose and the base;

a plurality of fragments disposed about the penetrator, wherein the nose includes an aft generally conical surface configured for outward deployment of the plurality of fragments, and wherein the kinetic energy fragmenting warhead is configured to disperse the plurality of fragments without the use of explosive materials; and a sleeve disposed about at least some of the plurality of fragments.

2. The kinetic energy fragmenting warhead of claim 1, wherein the plurality of fragments is disposed about the shaft.

3. The kinetic energy fragmenting warhead of claim 1, wherein the plurality of fragments comprises a first set of fragments, disposed proximate the nose, and a second set of fragments, disposed proximate the base.

4. The kinetic energy fragmenting warhead of claim 3, wherein the sleeve extends from proximate the base, over the second set of fragments, and partially over the first set of fragments.

5. The kinetic energy fragmenting warhead of claim 1, wherein the base exhibits a transverse dimension larger than a maximum transverse dimension of the nose.

6. The kinetic energy fragmenting warhead of claim 1, wherein the plurality of fragments comprises a first set of fragments disposed proximate a second set of fragments.

7. The kinetic energy fragmenting warhead of claim 6, wherein the sleeve extends over the second set of fragments and partially over the first set of fragments.

8. The kinetic energy fragmenting warhead of claim 1, wherein the sleeve is configured to crumple when impacting a target.

9. The kinetic energy fragmenting warhead of claim 1, wherein the warhead is configured to deploy the fragments generally uniformly radially away from the warhead.

10. The kinetic energy fragmenting warhead of claim 1, wherein the warhead is configured to deploy the fragments generally non-uniformly radially away from the warhead.

11. A projectile comprising:

a body; and a kinetic energy fragmenting warhead disposed in the body, the kinetic energy fragmenting warhead comprising:

a single-piece penetrator, wherein the penetrator comprises a nose, a base, and a shaft extending between the nose and the base;

a plurality of fragments disposed about the penetrator, wherein the nose comprises an aft, generally conical surface configured for outward deployment of the plurality of fragments, and wherein the kinetic energy fragmenting warhead is configured to disperse the plurality of fragments without the use of explosive materials; and a sleeve disposed about at least some of the plurality of fragments.

12. The projectile of claim 11, wherein the plurality of fragments is disposed about the shaft.

13. The projectile of claim 11, wherein the plurality of fragments comprises a first set of fragments, disposed proximate the nose, and a second set of fragments, disposed proximate the base.

14. The projectile of claim 13, wherein the sleeve extends from proximate the base, over the second set of fragments, and partially over the first set of fragments.

15. The projectile of claim 11, wherein the base exhibits a transverse dimension larger than a maximum transverse dimension of the nose.

16. The projectile of claim 11, wherein the plurality of fragments comprises a first set of fragments disposed proximate a second set of fragments.

17. The projectile of claim 16, wherein the sleeve extends over the second set of fragments and partially over the first set of fragments.

18. The projectile of claim 11, wherein the sleeve is configured to crumple when impacting a target.

19. The projectile of claim 11, wherein the warhead is configured to deploy the fragments generally uniformly radially away from the warhead.

20. The projectile of claim 11, wherein the warhead is configured to deploy the fragments generally non-uniformly radially away from the warhead.

* * * * *